US008353303B2

(12) United States Patent
Kim

(10) Patent No.: US 8,353,303 B2
(45) Date of Patent: Jan. 15, 2013

(54) PORTABLE FOLDING TYPE HAIRSTYLING TOOL

(75) Inventor: Hae Jin Kim, Seoul (KR)

(73) Assignee: GHD Korea, Inc., Chungcheongnam-Do (KR)

( * ) Notice: Subject to any disclaimer, the term of this patent is extended or adjusted under 35 U.S.C. 154(b) by 233 days.

(21) Appl. No.: 12/662,240

(22) Filed: Apr. 7, 2010

(65) Prior Publication Data

US 2011/0247641 A1 Oct. 13, 2011

(51) Int. Cl.

| | |
|---|---|
| ***A45D 24/10*** | (2006.01) |
| ***A45D 24/16*** | (2006.01) |
| ***A45D 7/02*** | (2006.01) |
| ***A45D 1/04*** | (2006.01) |

(52) U.S. Cl. ..... 132/118; 132/121; 132/212; 219/222

(58) Field of Classification Search ..... 132/118, 132/210, 211, 212, 213.1, 219, 106, 107, 132/120, 121, 122, 123, 126, 129, 132, 134, 132/135, 143, 147, 148, 150, 151, 223, 224, 132/227, 229, 230, 231, 232, 234, 235, 265, 132/269, 271, 286, 295, 313, 315; 220/735, 220/736; 206/208, 209, 581, 823, 234; 219/222, 219/223, 228, 229, 227; 34/96, 283; 392/379; D28/16, 23; 7/118, 167, 168, 170, 136; 81/427.5; 30/30; 15/184, 185

See application file for complete search history.

(56) References Cited

U.S. PATENT DOCUMENTS

| | | | | | |
|---|---|---|---|---|---|
| 1,530,070 | A | * | 3/1925 | Bovee | 132/314 |
| 1,536,669 | A | * | 5/1925 | Grant | 132/118 |
| 1,724,984 | A | * | 8/1929 | Wildey | 132/148 |
| 2,004,044 | A | * | 6/1935 | Fiegel | 132/120 |
| 2,181,448 | A | * | 11/1939 | Behr | 132/120 |
| 2,457,621 | A | * | 12/1948 | Aeres | 132/118 |
| 2,600,472 | A | * | 6/1952 | Brock | 132/118 |
| 3,173,428 | A | * | 3/1965 | Postel | 132/232 |
| 3,731,694 | A | * | 5/1973 | Moro | 132/118 |
| 3,760,821 | A | * | 9/1973 | Weddington | 132/118 |
| 3,903,905 | A | * | 9/1975 | Tucker | 132/118 |
| 3,955,064 | A | * | 5/1976 | Demetrio et al. | 219/225 |
| 3,973,528 | A | * | 8/1976 | Walter et al. | 132/120 |
| 4,032,747 | A | * | 6/1977 | Kunz | 219/222 |
| 4,075,458 | A | * | 2/1978 | Moyer | 219/225 |
| 4,101,757 | A | * | 7/1978 | Van Dyck et al. | 219/225 |
| 4,210,797 | A | * | 7/1980 | Tomaro | 219/225 |
| 4,215,264 | A | * | 7/1980 | Hetherington | 219/225 |
| 4,227,541 | A | * | 10/1980 | Satchell | 132/232 |
| 4,228,343 | A | * | 10/1980 | Kanner et al. | 219/225 |
| 4,242,567 | A | * | 12/1980 | Carter | 219/225 |
| RE30,618 | E | * | 5/1981 | Van Dyck et al. | 219/225 |
| 4,358,660 | A | * | 11/1982 | Andis | 219/222 |
| 4,366,365 | A | * | 12/1982 | Kunz et al. | 219/225 |
| 4,368,376 | A | * | 1/1983 | Andis | 219/222 |

(Continued)

*Primary Examiner* — Vanitha Elgart

(74) *Attorney, Agent, or Firm* — Bacon & Thomas, PLLC

(57) ABSTRACT

Disclosed herein is a portable folding type hairstyling tool. The hairstyling tool includes a casing unit which also serves as a handle, and a hairstyling unit which is inserted into or unfolded from the casing unit to be used by pivoting. The hairstyling unit includes an electric heating part for applying heat to the hair, and the casing unit includes a power source. The hairstyling unit has a rotary switch around a hinge part, thus allowing power to be supplied to the electric heating part by a power source only when the hairstyling unit is unfolded from the casing unit.

2 Claims, 9 Drawing Sheets

U.S. PATENT DOCUMENTS

| | | | | |
|---|---|---|---|---|
| 4,641,010 | A * | 2/1987 | Abura et al. | 219/222 |
| 4,739,151 | A * | 4/1988 | Smal | 219/225 |
| 4,857,702 | A * | 8/1989 | Cafaro | 219/225 |
| 4,928,716 | A * | 5/1990 | Greene | 132/212 |
| 5,832,939 | A * | 11/1998 | Nathe | 132/225 |
| 6,088,861 | A * | 7/2000 | Sessions et al. | 7/128 |
| 6,423,942 | B1 * | 7/2002 | Liao | 219/222 |
| 6,510,856 | B1 * | 1/2003 | Ahn | 132/219 |
| 6,675,419 | B2 * | 1/2004 | Rivera | 7/128 |
| 6,920,886 | B2 * | 7/2005 | McCambridge et al. | 132/232 |
| 7,284,557 | B1 * | 10/2007 | Williams | 132/212 |
| 7,465,904 | B2 * | 12/2008 | Kim et al. | 219/222 |
| 7,600,520 | B2 * | 10/2009 | Choi | 132/224 |
| 7,987,859 | B2 * | 8/2011 | Cafaro | 132/225 |
| 2005/0194016 | A1 * | 9/2005 | Yeh | 132/121 |
| 2006/0005330 | A1 * | 1/2006 | Rehkemper | 15/22.1 |
| 2007/0125397 | A1 * | 6/2007 | Harewood | 132/121 |
| 2007/0272266 | A1 * | 11/2007 | Rijskamp | 132/211 |
| 2008/0173322 | A1 * | 7/2008 | Leung | 132/232 |
| 2010/0263223 | A1 * | 10/2010 | Wynne | 34/97 |

* cited by examiner

PORTABLE FOLDING TYPE HAIRSTYLING TOOL

BACKGROUND OF THE INVENTION

1. Field of the Invention

The present invention relates generally to a portable hairstyling tool and, more particularly, to a portable hairstyling tool having a foldable iron to allow a user to carry the tool to care for the hair.

2. Description of the Related Art

Generally, a hair iron is a device that applies heat to the hair to create a variety of hairstyles, and is widely used in general beauty salons or the home for setting the hair.

When a person is outdoors, his or her hair may become disheveled. Especially at the present time when trips or outdoor activities are widely done, a person's hair is frequently disheveled, so that it is necessary to arrange his or her hair.

A hairstyle is important to the beauty of woman. Thus, the hairstyle is frequently changed to suit the time and place and to sufficiently exhibit an aesthetic sense. Therefore, it is preferable to carry tools which are used to arrange the hair or change a hairstyle.

Meanwhile, if only a comb is used to arrange wet, disheveled or curly hair, there are many inconveniences. Thus, in order to arrange the hair, a method of combing the hair while applying hot air thereto using a hair dryer is used. In this case, a user must hold a hair dryer with one hand while holding a comb with the other hand, that is, must use both hands, so that it is not easy to style the hair into the desired style. Further, in order to provide waves to the hair or straighten the hair, a hair iron which is constructed so that electric heating plates are attached to the inner surfaces of the front ends of a pair of handles which are joined together via a hinge is used.

Conventionally, in order to care for the hair, a person must carry a comb, a hair dryer which must be connected to a power source when it is being used, and a hair iron. These hairstyling tools occupy a large volume, are heavy, and require an external power source, so that portability is substantially low. Further, the tools are provided separately, so that they are complicated and inconvenient to use.

SUMMARY OF THE INVENTION

Accordingly, the present invention has been made keeping in mind the above problems occurring in the prior art, and an object of the present invention is to provide a portable hairstyling tool, which is of a size convenient to carry and is capable of styling the hair using heat.

In order to accomplish the above object, the present invention provides a portable folding type hairstyling tool, including a casing unit which also serves as a handle, and a hairstyling unit inserted into or unfolded from the casing unit to be used by pivoting. The hairstyling unit includes an electric heating part for applying heat to the hair, and the casing unit includes a power source.

The hairstyling unit which functions to care for the hair may be detachably coupled to the casing unit.

The hairstyling unit may have a rotary switch around a hinge part, thus allowing power to be supplied to the electric heating part by a power source only when the hairstyling unit is unfolded from the casing unit.

The hairstyling unit may comprise a comb and an iron. Here, the comb may have a teeth part having teeth, the ends of which are spaced apart from each other, and a back part which joins the teeth together. That is, the comb may have a plurality of teeth which are arranged in one direction in such a way that the ends thereof are spaced apart from each other, and a back of the comb which is connected to an end opposite to the ends of the plurality of teeth which are spaced apart from each other, thus joining the plurality of teeth together. A heating plate of the iron may be provided in the back of the comb.

The hairstyling unit may further include a back cover which faces the back of the comb, and approaches the heating plate of the back of the comb or moves away therefrom by pivoting using a hinge and a spring. An additional heating plate may be provided on the inner surface of the back cover in such a way as to face the heating plate of the back of the comb.

The hairstyling unit may include a comb and a heating plate having a heating part which is shaped to correspond to the teeth of the comb. Here, a side of the heating plate may be split similarly to the teeth of the comb, and the split parts may be installed to correspond to the teeth of the comb. Thus, when combing the hair, the heating part of the heating plate may come into contact with the hair between the teeth, thus applying heat to the hair.

The hairstyling unit may comprise an iron. In this case, the iron may comprise two parts. The two parts may come near each other or move away from each other through pivoting using a hinge and a spring, at a hinge part at which the two parts are coupled to a casing unit. Heating plates may be attached to facing inner surfaces of the two parts. Thus, a desired hairstyle may be obtained by inserting the hair between the heating plates and moving the heating plates along the hair.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the accompanying drawings.

Figure 1:
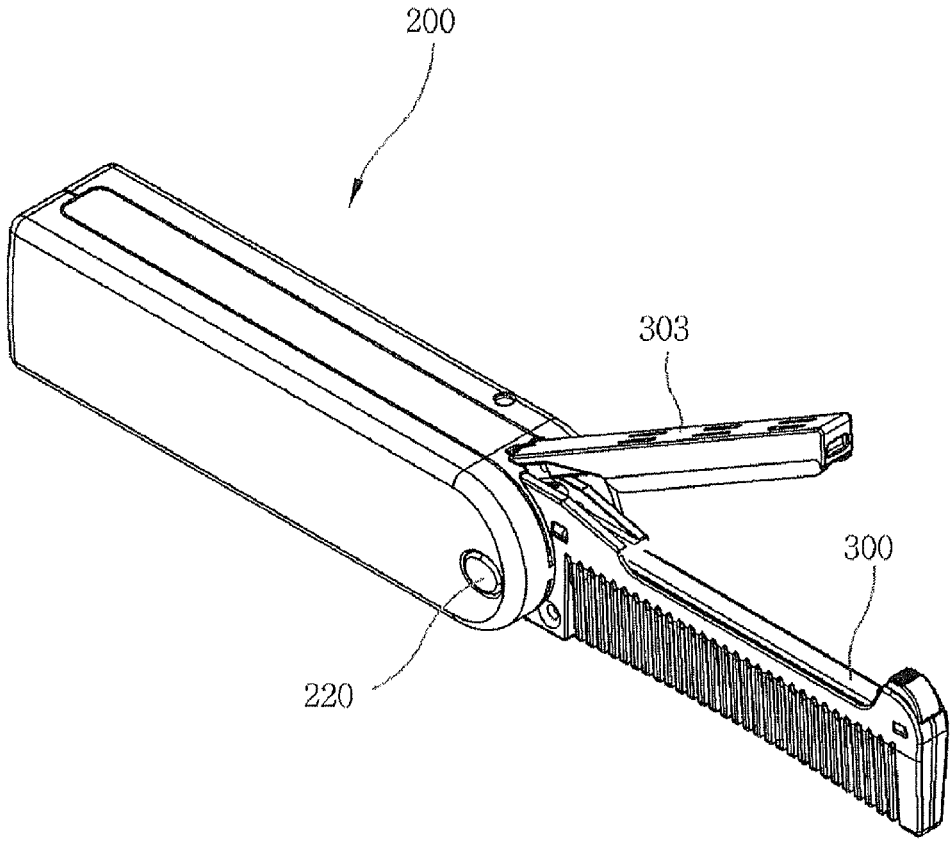
FIG. 1 is a perspective view illustrating a hairstyling tool according to an embodiment of the present invention.

FIG. 1 is a perspective view illustrating a hairstyling tool according to an embodiment of the present invention.

The portable folding type hairstyling tool is provided with a casing unit 200 which collaterally serves as a handle, and a hairstyling unit 300 which is inserted into the casing unit 200 or is unfolded from the casing unit 200 to be used. The hairstyling unit 300 is inserted into the casing unit 200 or unfolded from the casing unit 200 by pivoting. For the pivoting, the casing unit 200 and the hairstyling unit 300 partially overlap each other in a longitudinal direction and are joined to each other by a hinge part 220. Further, the hinge part 220 may be simply disassembled from the outside, and the hairstyling unit 300 is detachably coupled to the casing unit 200.

Figure 2:
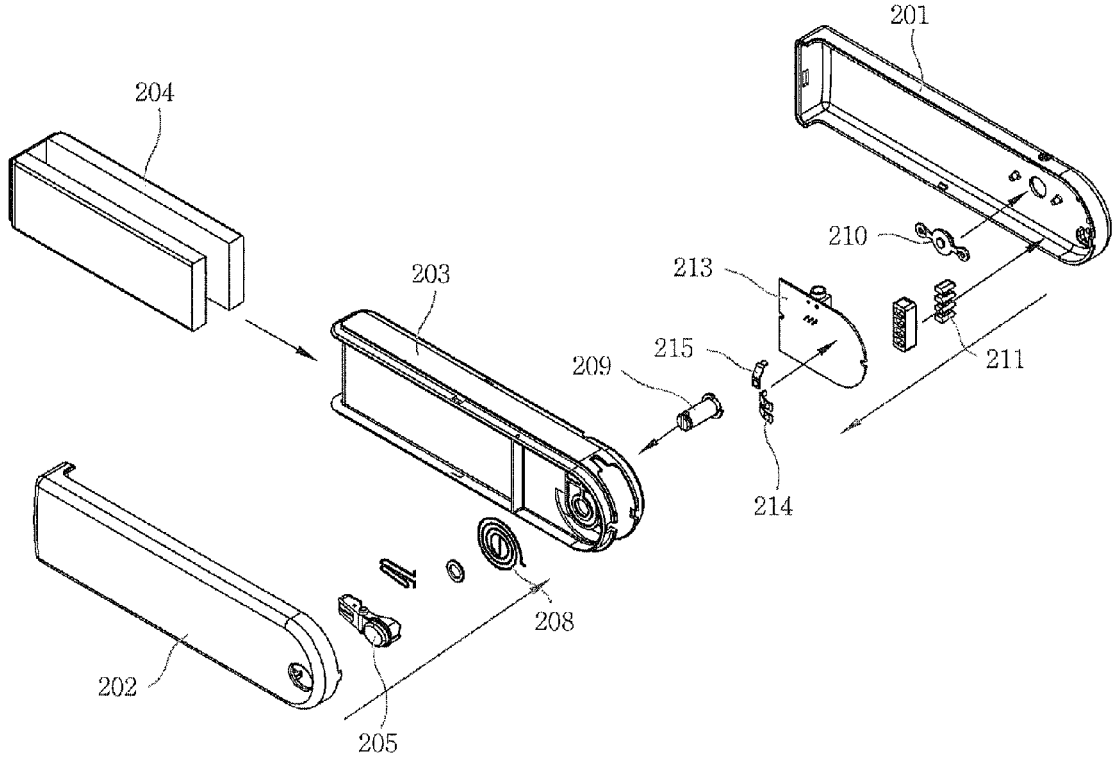
FIG. 2 is an exploded perspective view showing a casing unit of the hairstyling tool of FIG. 1.

FIG. 2 is an exploded perspective view showing the casing unit of FIG. 1.

The casing unit 200 includes a casing 203 which has a rectangular shape and serves as a central body when viewed in a transverse direction. The middle portion of, the casing 203 in a transverse direction thereof has an empty space to allow the hairstyling unit 300 to be inserted therein. Thus, the casing 203 has front and rear rectangular walls on opposite sides of the empty space. The walls are coupled to each other by ribs which are provided along the edges of the walls of the confined range so as not to hinder the insertion of the hairstyling unit 300. Further, a front cover 202 and a rear cover 201 are attached, respectively, to the front and rear of the casing 203 in a transverse direction thereof. A rectangular battery 204 is provided between the front cover 202 and the front rectangular wall of the casing 203 and between the rear rectangular wall of the casing 203 and the rear cover 201.

A Printed Circuit Board (PCB) 213 placed between the casing 203 and the rear cover 201, connection terminals 214 and 215 connected to the PCB 213, and an LED lamp 211 are provided around the hinge part. A pin 209, a brush spring 208, and a brush lock 205 are provided on the hinge part. The brush spring 208 is provided around the pin 209. The brush lock 205 functions to lock the hairstyling unit 300 in the casing unit 200. A power switch 210 is provided to be exposed to the cover surface of the casing.

Figure 3:
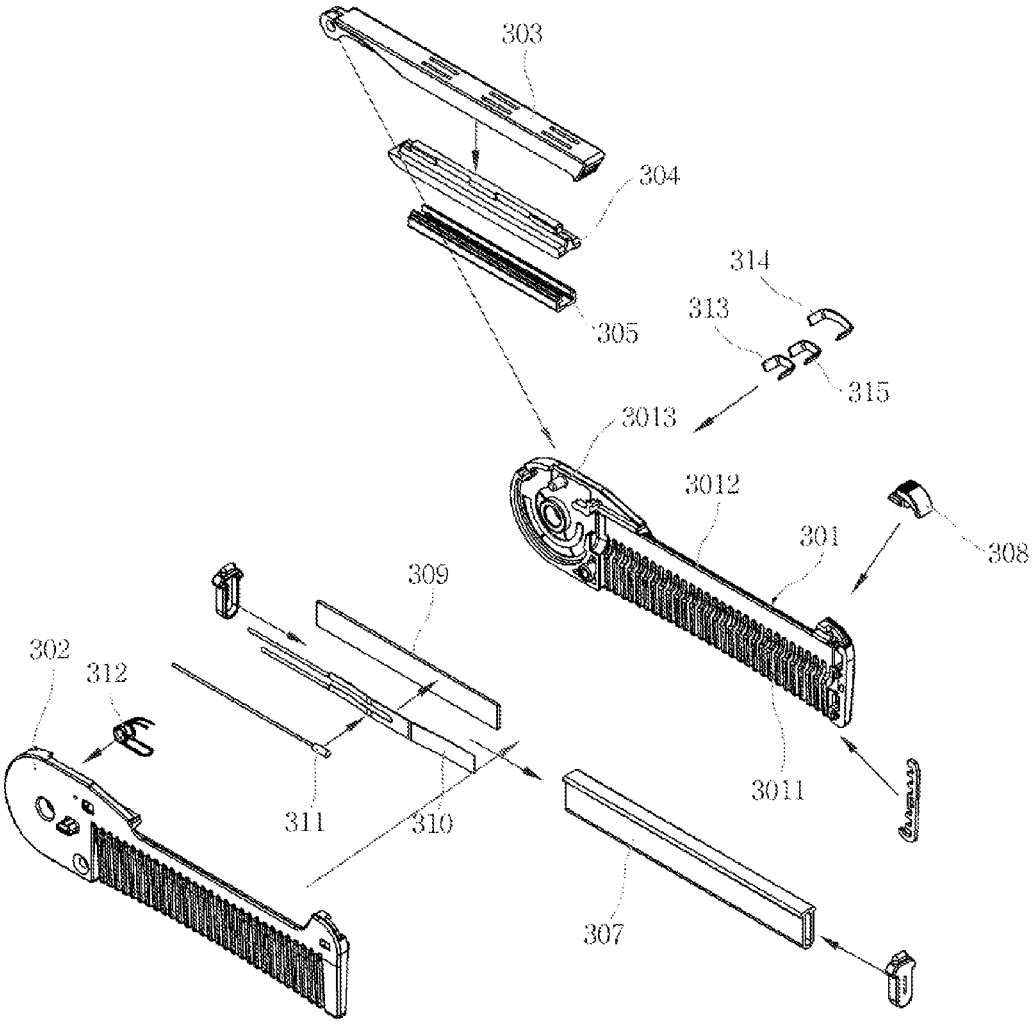
FIG. 3 is an exploded perspective view showing a hairstyling unit of FIG. 1.

FIG. 3 is an exploded perspective view showing the hairstyling unit of FIG. 1.

The hairstyling unit 300 has the shape of a comb. Thus, this embodiment has the overall appearance of a foldable comb. When the hairstyling unit is unfolded from the casing unit 200 to form a 180 degree angle with the casing unit 200, comb teeth 3011 which are provided on the lower portion of the comb are similar to those of a general comb, but the back 3012 of the comb which is provided on the upper portion of the comb is different from that of a general comb. That is, a cover 303 is provided above the back 3012, separately from the comb. The comb 301 and the cover 303 are joined together by a hinge structure which is different from the hinge part joining the casing unit 200 with the hairstyling unit 300. The hinge structure is provided with a subsidiary spring 312 to perform pivoting.

Thus, the comb 301 and the cover 303 pivot about a hinge pin 3013 of the hinge structure, so that the cover 303 may completely cover the back 3012 of the comb when the cover 303 approaches the back 3012, or the cover 303 may be spaced from the back 3012 at a predetermined angle. A heating plate 307 is mounted to the body of the comb 301. A portion of the heating plate 307 is laid between the body of the comb 301 and a side cover 302, the lower portion of the heating plate 307 is exposed to the teeth 3011, and the flat surface of the top of the heating plate 307 is exposed to the back 3012 of the comb. When combing the hair, the lower portion of the heating plate 307 exposed to the teeth 3011 comes into contact with the hair, thus providing a desired shape to the hair while drying the hair. The flat surface of the heating plate 307 serves as a heating plate of the hair iron and is used for styling a user's hair when in contact with the hair. The heating plate 307 laid in the body of the comb is empty along a central axis in a longitudinal direction thereof, and a heater 309 is installed in the empty space. Power is supplied from the battery 204 of the casing unit to the heater 309, and a Negative thermal coefficient (NTC) element 311 is installed at a position around the heater 309, thus controlling the temperature so as to prevent overheating.

The use of the hairstyling tool according to this embodiment will be described below. First, a user presses the brush lock 205 so that the hairstyling unit 300 is unfolded from the casing unit 200 to be open. When the button of the power switch 210 exposed to the rear cover 201 is pressed, electricity flows through the battery 204, a controller of the PCB 213, the connection terminals 214 and 215, and the connection terminals 313, 314, and 315 of the hairstyling unit 300 to the NTC element 311, a heater press 310, and the heater 309. If the heating plate 307 is heated by the heater 309, a user may comb his or her hair with the comb having the heating plate 307, the lower portion of which is exposed, or may use the flat surface provided on the top of the heating plate 307 like the heating plate of a plate-type hair iron, according to a desired styling method.

The method of using the flat surface will be described below in detail. The hairstyling unit 300 includes a subsidiary lock 308 which is opposite in a longitudinal direction of the hairstyling unit to the hinge part for joining the cover 303 with the comb 301 and performs a locking operation when the cover 303 is in the state of making close contact with the comb 301. The subsidiary lock 308 is open and unlocked to operate the subsidiary spring 312 provided around the hinge part, thus causing the cover 303 to be spaced apart from the comb 301. The hair is placed between the flat surface of the heating plate 307 and the cover 303, and force is exerted by the hand so that the cover 303 is pressed. Thereby, in the state in which the hair is interposed between the flat surface of the heating plate 307 and the cover 303, the cover 303 comes into contact with the back 3012 of the comb. In such a state, the hairstyling tool is naturally pulled to be perpendicular to the longitudinal direction of the cover 303 or is rotated, thus straitening or gently curling the hair.

In this embodiment, a heat resistant rubber plate 304 is attached to the inner surface of the cover 303 without an additional heating plate being installed. However, a heating plate 305 and a heater may be provided in the cover 303 to be used for hair styling. The cover 303 and the body of the comb 301 may be made of a synthetic resin having high heat resistance and insulating ability, for example, a fluorine resin such as Teflon, so that the cover 303 and the comb 301 are not damaged at the temperature (about 180° C.) of the heating plate 305.

In the hairstyling tool constructed as described above, the heating plate and the heater are small, so that power consumption is small and thus the power consumption of the portable hairstyling tool can be minimized. Such a hairstyling tool allows a user to temporarily care for the hair by combing the hair or using the tool as a hair iron; the hairstyling tool of this invention is a hair iron of a very simple structure.

Because the hairstyling tool according to the present invention has the characteristic of a user being able to carry it, it is necessary to pay attention to safety. For example, in order to supply power from the battery 204 to the heating plate 307 of the hairstyling unit 300 only when the hairstyling unit 300 is unfolded from the casing unit 200, the rotary switch of FIG. 9 may be installed. To this end, conductive contact points, connected to an electric device such as the heater 309 of the hairstyling unit 300 and the battery 204 of the casing unit 200, are installed to facing surfaces of the hairstyling unit 300 and the casing unit 200, around the hinge part which pivotally joins the hairstyling unit 300 and the casing unit 200 together. Further, the conductive contact points of the casing unit 200 come into contact with the corresponding conductive contact points of the hairstyling unit 300 only when the hairstyling unit 300 is unfolded from the casing unit 200, thus enabling electricity to be delivered between the battery 204 of the casing unit 200 and the electric device of the hairstyling unit 300.

Figure 9:
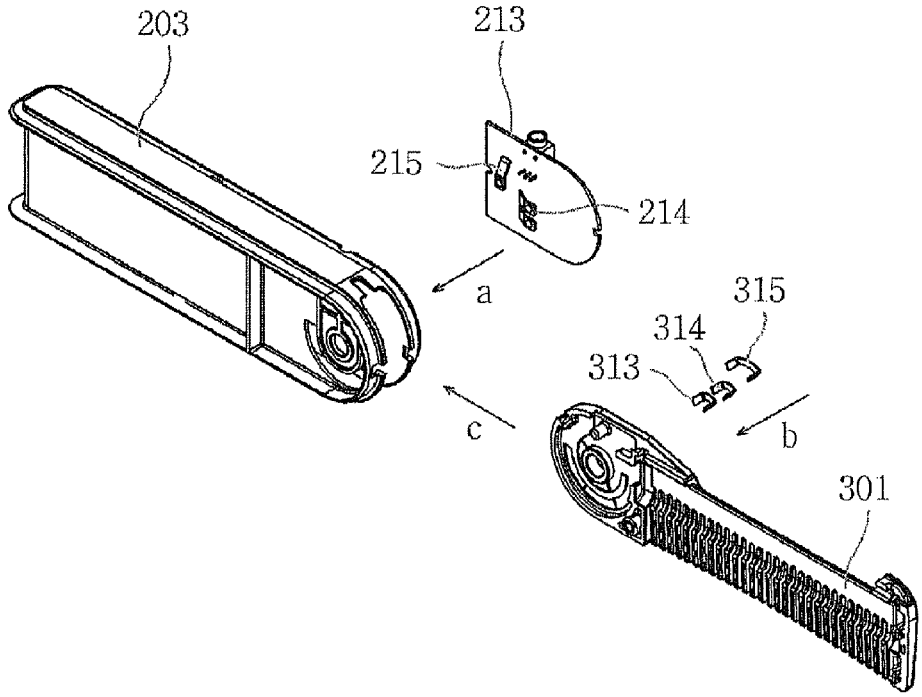
FIG. 9 is a perspective view showing a rotary switch which is provided on a hinge part of the hairstyling tool of FIG. 1 to electrically connect the hairstyling unit with the casing unit.

As shown in FIG. 9, the connection terminals 214 and 215 of the casing unit 200 are connected to the PCB 213, and the PCB 213 is connected to the casing 203 in direction 'a' (the transverse direction) in such a way as to be exposed toward the empty space in the casing 203. The connection terminals 313, 314, and 315 of the hairstyling unit 300 are connected in direction 'b' (the transverse direction) to an exposed surface of the comb 301 which is not covered by the side cover 302 on a hinge side of the hairstyling unit 300 in such a way that the connection terminals 313, 314, and 315 face the exposed PCB 213. The comb 301 is coupled to the casing 203 in direction c (the longitudinal direction) and fastened by the hinge pin. The positions of the connection terminals are determined such that the corresponding connection terminals are in contact with each other when the hairstyling unit 300 is unfolded from the casing unit 200 and is open at 180 degrees, thus electrically connecting the battery 204 of the casing unit 200 to the electric device of the hairstyling unit 300.

Further, the power switch 210 is provided in the casing unit 200 in such a way that the button of the power switch 210 is exposed to the cover, thus allowing the delivery of electricity between the battery 204 and the connection terminals 214 and 215 to be checked once again. That is, only when the hairstyling unit 300 is unfolded from the casing unit 200 and the button of the casing unit 200 is pushed may power be supplied from the battery 204 to the heater 309. If the hairstyling unit 300 is folded and inserted into the casing unit in the state in which the button of the casing unit 200 is pushed, the connection terminals are disconnected from each other and the power switch 210 automatically opens, thus interrupting once again the supply of power to the heater 309.

Figure 4:
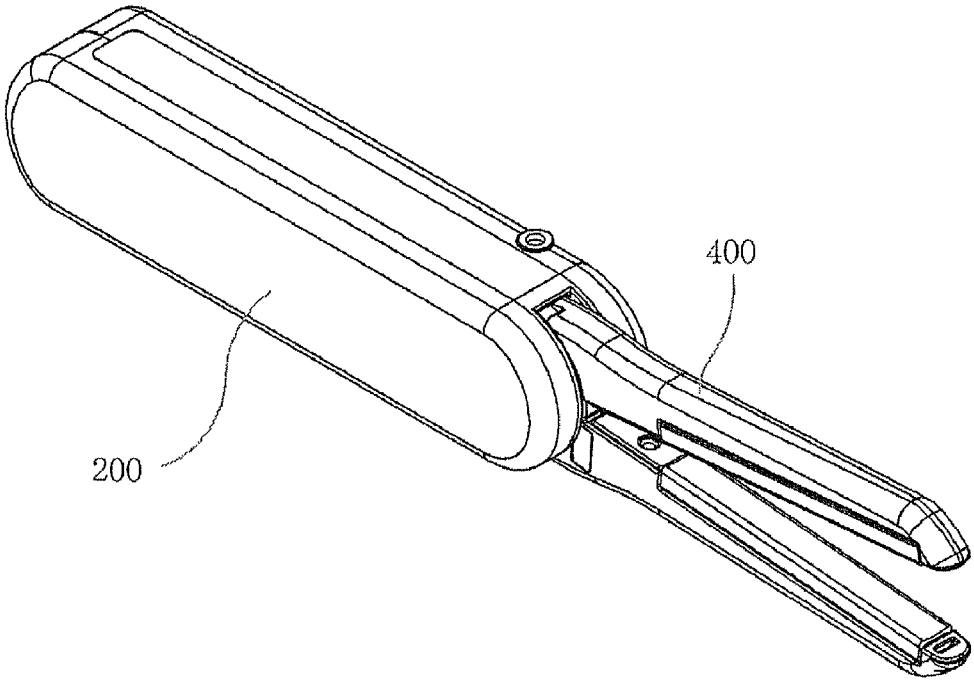
FIG. 4 is a perspective view illustrating a hairstyling tool according to another embodiment of the present invention.
Figure 5:
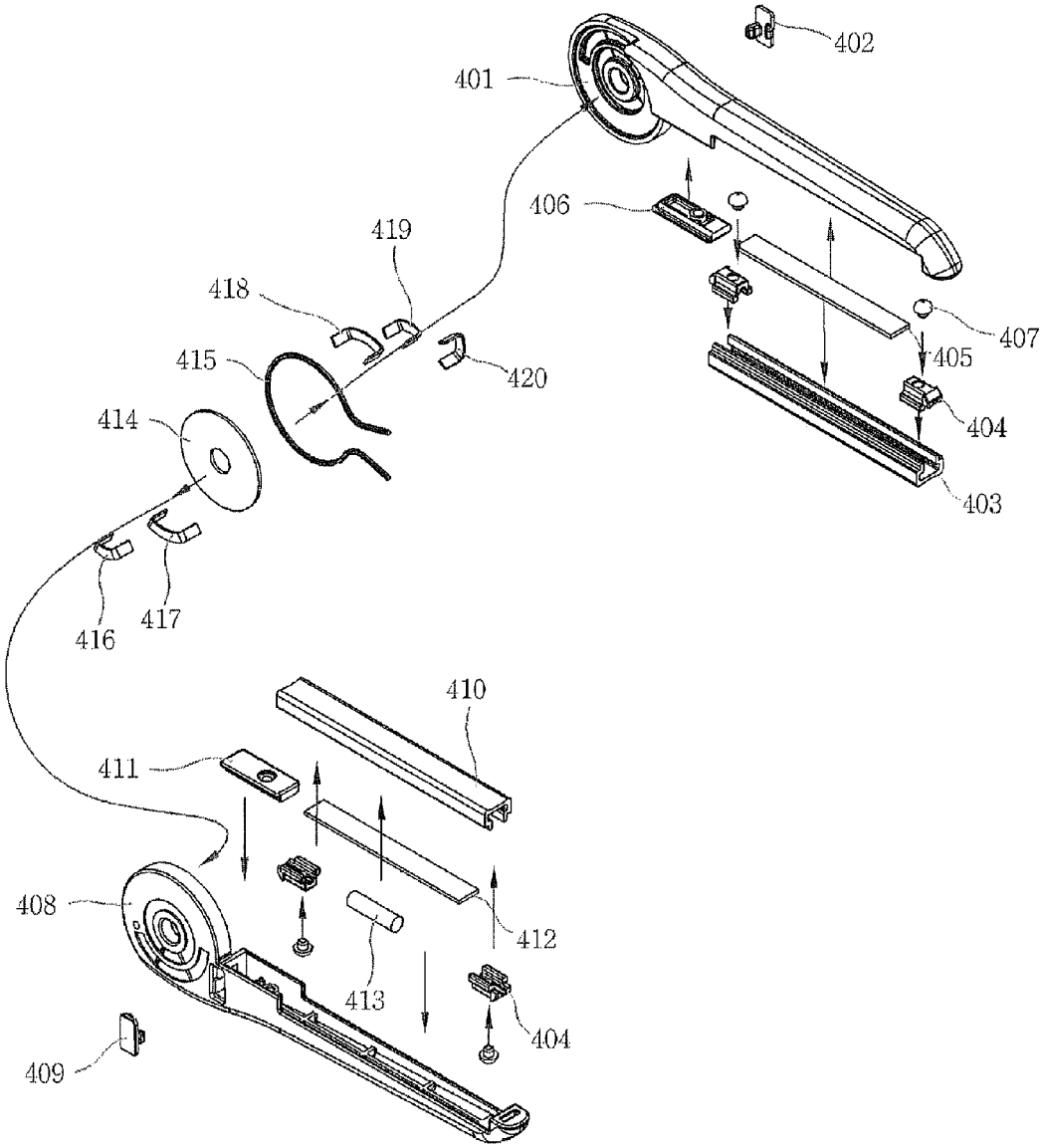
FIG. 5 is an exploded perspective view showing a hairstyling unit of FIG. 4.

FIG. 4 is a perspective view illustrating a hairstyling tool according to another embodiment of the present invention, and FIG. 5 is an exploded perspective view showing a hairstyling unit of FIG. 4.

A casing unit 200 according to the embodiment of FIG. 4 has the same shape as the casing unit 200 according to the embodiment of FIG. 1. Both the embodiments are the equivalent of each other with the exception of the shape of the hairstyling unit. This embodiment will be described in detail with reference to the exploded perspective view of FIG. 5. A hairstyling unit 400 comprises a plate-type hair iron having two upper and lower casings 401 and 408.

The two casings 401 and 408 may pivot or rotate about the hinge pin 209 (see FIG. 2) within a predetermined angular range thanks to a subsidiary spring 415 which is provided around a hinge part in the casings 401 and 408. Heating plates 403 and 410 having on opposite inner surfaces of the casings 401 and 408 flat surfaces are provided in the casings 401 and 408 in such a way as to extend from an end distant from the hinge part to a position corresponding to ⅔ of the length of each casing. Heaters 405 and 412 are mounted to inner surfaces of the heating plates 403 and 410, which are not exposed to the outside. In the state in which the heaters 405 and 412 are mounted, the heating plates 403 and 410 are held by holders 404 to be placed between the upper casing 401 and the lower casing 408 of the hairstyling unit 400. A cushion 407, made of an elastic material, is installed between each holder 404 and the corresponding casing, and provides flexibility in such a way that each heating plate 403 or 410 moves within a predetermined range.

Body covers 406 and 411 covering the casings are provided in place of the heating plates in such a way as to extend from a position near the hinge part to a position corresponding to ⅓ of the length of each casing. Conducting wires are installed in the body covers 406 and 411 to connect connection terminals 416, 417, 418, 419 and 420 to the heaters 405 and 412, a fuse 413 provided around the heater, or a PTC element (not shown). A sliding disc 414 which rotates around the hinge pin and the connection terminals 416, 417, 418, 419 and 420 which connect the heaters, the PTC element, and the fuse of the hairstyling unit 400 to the battery of the casing unit are provided on the hinge part.

Leg-caps 402 and 409 are provided on portions of the casings adjacent to the hinge part, and serve as a locking unit to prevent the subsidiary spring 415 from being operated when the two casings 401 and 408 are inserted and held in the casing unit 200.

The method of using the hairstyling tool according to this embodiment will be described below. First, a user presses the brush lock 205 so that the hairstyling unit 400 is unfolded from the casing unit 200 and opens. When the button of the power switch 210 exposed to the rear cover 201 is pressed, electricity flows through the battery 204, the controller of the PCB 213, the connection terminals 214 and 215, and the connection terminals 416, 417, 418, 419 and 420 of the hairstyling unit 400 to the heaters 405 and 412 and the fuse 413. In the state in which the upper and lower casings 401 and 408 of the hairstyling unit 400 pivot around the hinge pin, when the heating plates 403 and 410 are heated, the hair is placed between the heating plates 403 and 410 of the upper and lower casings 401 and 408 and force is exerted by the hand. At this time, locks of the hair interposed between the heating plates 403 and 410 of the upper and lower casings 401 and 408, come into contact with each other. In such a state, when the hairstyling tool is naturally pulled to be perpendicular to the longitudinal direction of the heating plates 403 and 410, the hair can be straightened.

Also, in the state in which the two heating plates 403 and 410 are in contact with each other and come into contact with the leg-caps, when the upper and lower casings 401 and 408 are inserted into the casing unit 200, the brush lock 205 is locked, thus providing storage for the hairstyling tool.

Figure 6:
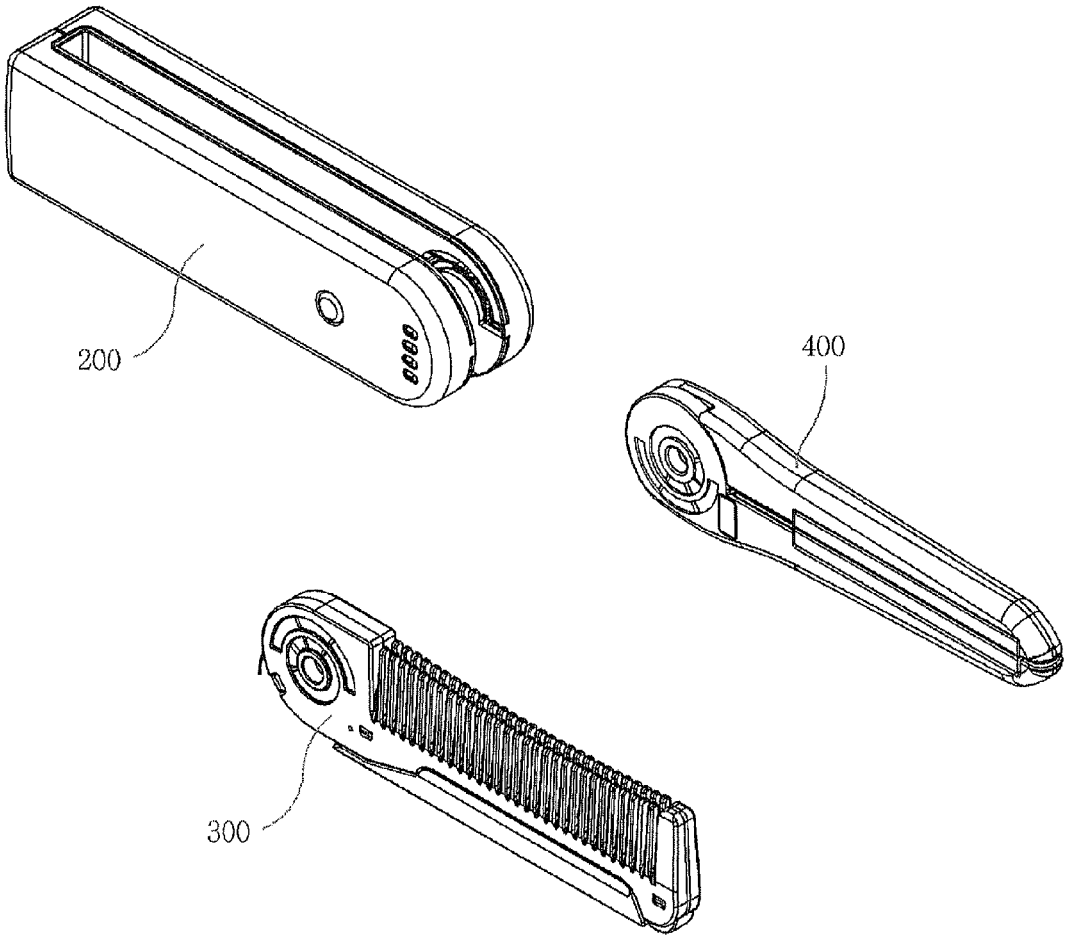
FIG. 6 is a perspective view showing two hairstyling units which may be alternatively attached to the casing unit, wherein the hairstyling units are separated from the casing unit.

According to the above-mentioned embodiments, one hairstyling unit of FIG. 3 or FIG. 5 is coupled to one casing unit. However, as described above with reference to FIG. 1, the casing unit and the hairstyling unit may be detachably coupled to each other by the hinge part. Therefore, as in the embodiment illustrated in the perspective view of FIG. 6, two hairstyling units 300 and 400 may be prepared for one casing unit 200. Thus, by coupling a desired hairstyling unit to the casing unit as necessary, a desired hairstyle can be obtained.

Meanwhile, a plurality of empty spaces may be formed in one casing unit 200 to allow a plurality of hairstyling units to be coupled to one casing unit, and a desired hairstyling unit may be pulled out from the casing unit to be used. In this case, two or more spaces must be provided, so that the width of the product is inevitably increased. However, such a construction is advantageous in that it is not necessary to detach or attach the hairstyling unit nor is it necessary to store a detached hairstyling unit with another hairstyling unit coupled to the casing unit, so that complicatedness and inconvenience are overcome. Preferably, a connection end of the hinge part is adjusted, so that when the button of the power switch is pressed, an electric current flows only to the heating plate of the hairstyling unit which is unfolded from the casing unit. Similarly to the above-mentioned embodiments, only when the hairstyling unit is unfolded from the casing unit does a switch pin of the hairstyling unit come into contact with a semicircular strip-shaped switch plate provided around the hinge part of the casing unit, thus enabling electricity to be delivered from the battery of the casing unit to the hairstyling unit.

Figure 7:
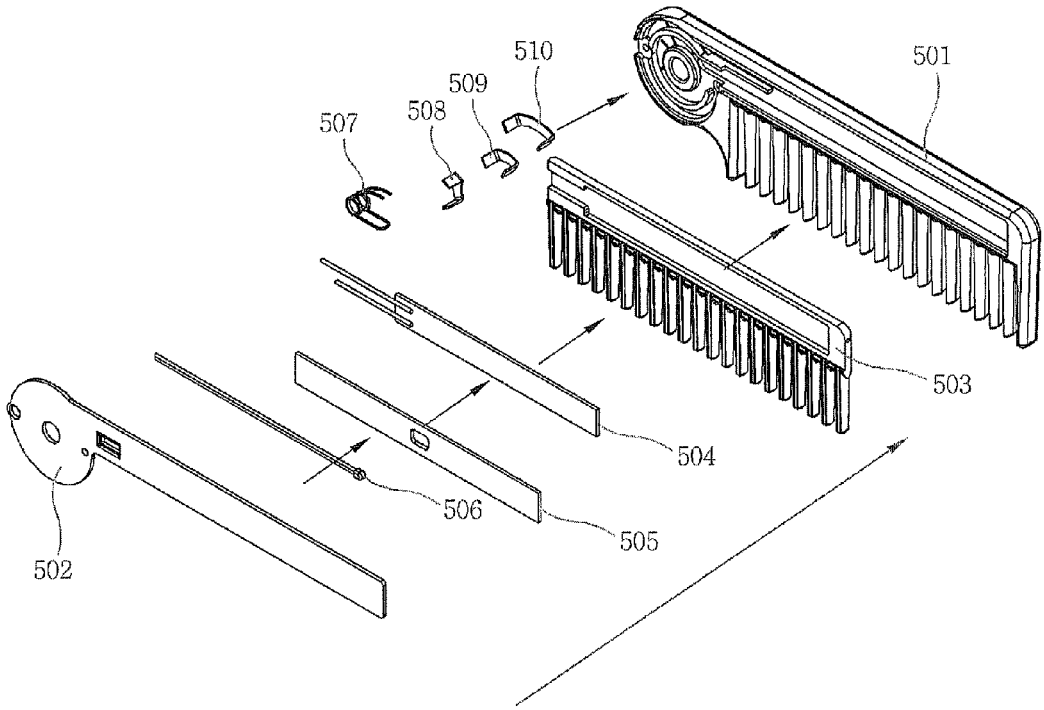
FIGS. 7 and 8 are exploded perspective views showing hairstyling units which may substitute for the hairstyling units according to the embodiments of the present invention or may be used together therewith.
Figure 8:
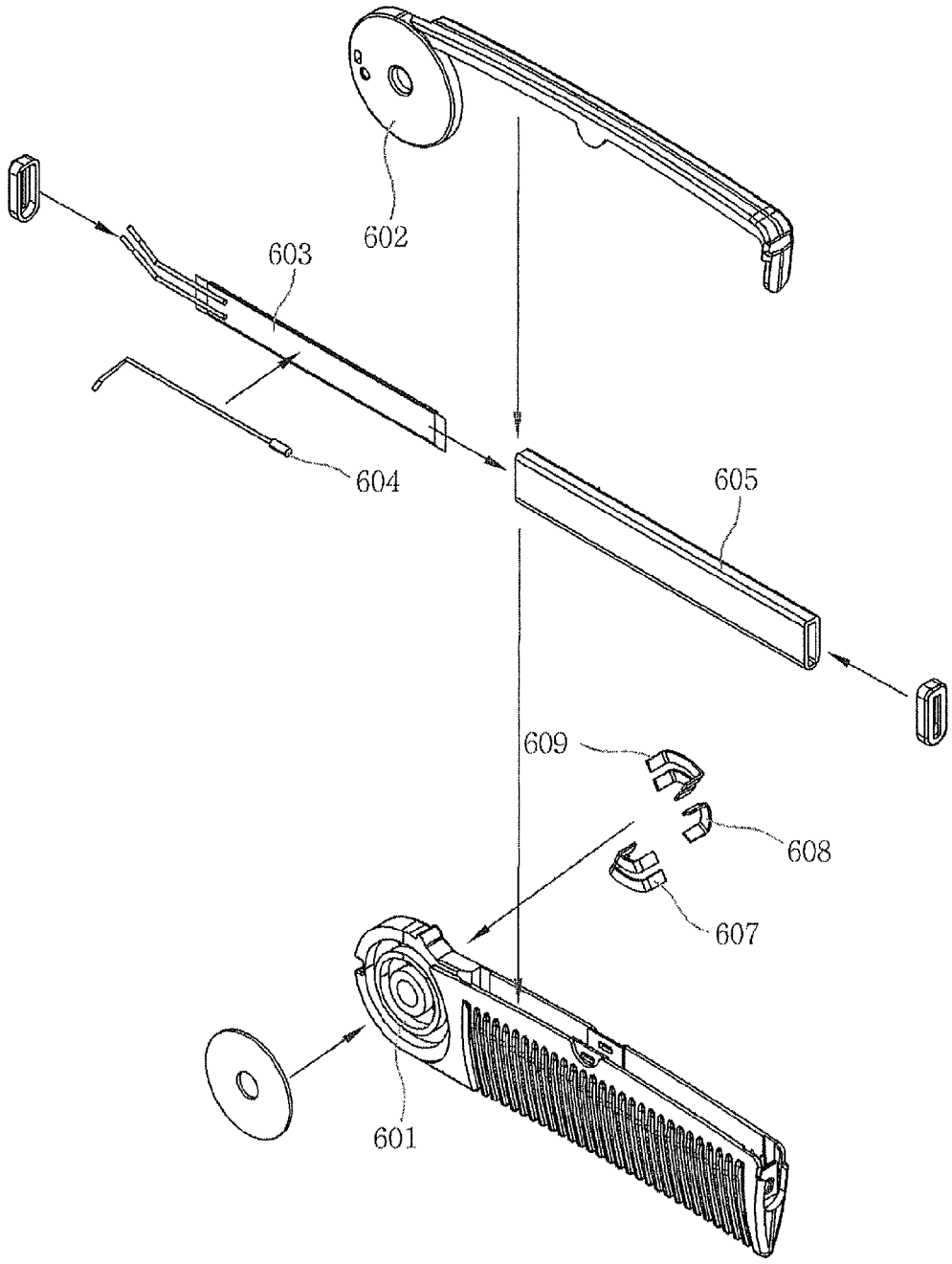

FIGS. 7 and 8 are exploded perspective views showing hairstyling units which may substitute for the hairstyling units according to the embodiments of the present invention or which may be used together therewith.

FIG. 7 shows a comb-shaped hairstyling unit which is similar to the hairstyling unit of FIG. 3. The comb-shaped hairstyling unit has a groove for mounting a heating plate 503 to the side surface of the back of a comb 501, and a cover 502 is formed to cover the groove. The heating plate 503 has no upper flat surface and is laid in the groove such that the upper end thereof is not exposed to the upper end of the body of the comb 501. The comb-shaped heating plate 503 is installed in the groove. The heating plate 503 has a planar part corresponding to the back of the comb and parts corresponding to the teeth of the comb. The parts of the heating plate 503 corresponding to the comb teeth are smaller in length than the teeth of the comb, thus preventing the heating plate 503 from coming into direct contact with a scalp when combing the hair. The planar part corresponding to the back of the comb has a groove. A heater 504 is installed in the groove, and an NTC element 506 is installed around the heater 504. An intermediary plate 505 having a contact hole is installed so that the conducting wire of the NTC element 506 is not in direct contact with the heater 504 but the NTC element 506 is in contact with the middle portion of the heater 504.

Holes through which the hinge pin 209 (see FIG. 2) passes are formed in the body of the comb 501 and the cover 502, and a subsidiary spring 507 and connection terminals 508, 509, and 510 are installed around the hinge pin 209. The connection terminals 508, 509, and 510, the heater 504, and the NTC element 506 are connected by conducting wires (not shown) connected to the heater and the NTC element.

In order to endure the heat of the heater 504, the peripheral part of the heating plate 503 is made of heat-resistant plastic. Preferably, the parts of the heating plate 503 corresponding to the teeth of the comb 501 are installed between the teeth of the comb 501 and formed to be narrower than the teeth of the comb 501, thus preventing the heating plate 503 from being exposed to the outside, therefore preventing the heating plate 503 from coming into direct contact with the hand or the like.

FIG. 8 shows a hairstyling unit which is similar to that of FIG. 3.

Unlike the hairstyling unit of FIG. 3, the hairstyling unit includes a cover 602 which is fixed to completely surround the back of a comb, in place of the cover which may pivot relative to the comb while surrounding the back of the comb. Such a construction has difficulty in achieving the same result as the plate-type hair iron which cares for the hair using the heating plate 605 exposed by opening the cover 602, and serves to simply dry the hair while pulling the comb 601 through the hair or to bend the hair by adjusting the direction of combing. A heater 603 and an NTC element 604 are installed in the heating plate 605, and connection terminals 607, 608 and 609 are installed, similarly to the hairstyling unit of FIG. 3.

The hairstyling units of FIGS. 7 and 8 may substitute for the hairstyling unit of FIG. 4. When the hairstyling units are installed in the casing unit and then are selectively used, they may perform a function similar to that of FIG. 2.

As described above, the present invention provides a portable folding type hairstyling tool, which is constructed so that a hairstyling unit having an electric heating part therein is easily folded to be inserted into a casing unit or unfolded to be open from the casing unit, thus reducing the size of the tool and making it easy to carry and convenient to use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A portable folding type hairstyling tool, comprising:

a casing unit also serving as a handle; and a hairstyling unit inserted into or unfolded from the casing unit to be used by pivoting;

wherein the hairstyling unit comprises a heating plate for applying heat to hair, and the casing unit comprises a battery as a power source for the heating plate;

wherein the hairstyling unit comprises a comb, the comb having a plurality of teeth which are arranged in one direction in such a way that ends thereof are spaced apart from each other, and having a back of the comb which is connected to an end opposite to the ends of the plurality of teeth which are spaced apart from each other, thus joining the plurality of teeth together, with the heating plate being provided in the back of the comb; and wherein the hairstyling unit further comprises a back cover, the back cover facing the back of the comb and pivoting about a hinge common to the back cover and the comb such that the back cover approaches the comb or moves away from the comb.

2. The hairstyling tool as set forth in claim 1, wherein an additional heating plate is provided on an inner surface of the back cover in such a way as to face the heating plate of the back of the comb.

* * * * *